United States Patent [19]

Holtermann et al.

[11] Patent Number: 4,820,213

[45] Date of Patent: Apr. 11, 1989

[54] FUEL RESIDUAL HANDLING SYSTEM

[75] Inventors: Theodore J. Holtermann, Brookfield; James L. Hofmann, Milwaukee, both of Wis.

[73] Assignee: Outboard Marine Corporation, Waukegan, Ill.

[21] Appl. No.: 105,177

[22] Filed: Oct. 5, 1987

[51] Int. Cl.[4] ..... B63H 21/14

[52] U.S. Cl. ..... 440/88; 123/73 R

[58] Field of Search ..... 440/88, 89; 123/73 R, 123/73 A, 73 PP

[56] References Cited

U.S. PATENT DOCUMENTS

| | | | |
|---|---|---|---|
| 1,733,431 | 10/1929 | Sherman | 123/73 R |
| 2,502,968 | 4/1950 | Lundquist et al. | 123/73 R |
| 2,717,584 | 9/1955 | Upton | 123/73 A |
| 2,781,632 | 2/1957 | Meijer | 123/196 CP |
| 2,857,903 | 10/1958 | Watkins | 123/196 CP |
| 3,128,748 | 4/1964 | Goggi | 123/196 |
| 3,170,449 | 2/1965 | Goggi | 123/136 |
| 3,528,395 | 9/1970 | Goggi | 123/73 |
| 3,709,202 | 1/1973 | Brown | 123/73 R |
| 3,730,149 | 5/1973 | Brown | 123/73 R |
| 3,762,380 | 10/1973 | Schultz | 123/73 R |
| 3,800,753 | 4/1974 | Sullivan et al. | 123/73 A |
| 3,805,751 | 4/1974 | Resnick et al. | 123/73 R |
| 3,859,967 | 1/1975 | Turner et al. | 123/73 A |
| 3,929,111 | 12/1975 | Turner et al. | 123/73 R |
| 4,063,540 | 12/1977 | Pace | 123/119 R |
| 4,121,551 | 10/1978 | Turner | 123/59 B |
| 4,133,284 | 1/1979 | Holcroft | 440/88 |
| 4,176,631 | 12/1979 | Kanao | 123/73 PP |
| 4,180,029 | 12/1979 | Onishi | 123/73 R |
| 4,181,101 | 1/1980 | Yamamoto | 123/73 A |
| 4,213,431 | 9/1981 | Baltz et al. | 123/187.5 R |
| 4,359,975 | 11/1982 | Heidner | 123/73 R |
| 4,383,503 | 5/1983 | Griffiths | 123/73 PP |
| 4,512,294 | 4/1985 | Mohr | 440/88 |
| 4,590,897 | 5/1986 | Hundertmark | 123/73 A |

*Primary Examiner*—Sherman D. Basinger
*Assistant Examiner*—Stephen P. Avila
*Attorney, Agent, or Firm*—Michael, Best & Friedrich

[57] ABSTRACT

Disclosed herein is a marine propulsion device comprising a lower unit including a rotatably mounted propeller and an internal combustion engine operable in a predetermined mode and adapted to be drivingly connected to said propeller, the engine including an engine block, a sump having an outlet and having an unobstructed inlet communicating with said engine block to provide a free gravity flow path from the engine block into the sump, a controllable valve communicating with the outlet, a fluid conduit communicating with the controllable valve and with a preselected location within the engine block, and a control mechanism responsive to operation of the engine in the predetermined mode for opening the controllable valve when the engine is operating in the predetermined mode.

18 Claims, 1 Drawing Sheet

FUEL RESIDUAL HANDLING SYSTEM

BACKGROUND OF THE INVENTION

This invention relates generally to internal combustion engines and particularly to two-cycle internal combustion engines wherein lubricant is mixed with fuel and wherein a drain is provided for collecting and recirculating residual fuel accumulated within the engine.

Moving parts within most two-cycle internal combustion engines are lubricated by means of a fuel/oil mixture introduced as a droplet cloud or mist into the engine's crankcase during engine operation. Although the fuel/oil mixture is in the form of a droplet cloud or mist when it is introduced into the crankcase, a portion of the droplet mist condenses to form a lubricating film on various moving and stationary surfaces within the crankcase. The thickness of the lubricating film thus formed is dependent upon various factors such as engine and fuel temperature, the air/fuel ratio, the fuel/oil ratio, and the velocity of air flow through the crankcase. The lubricating film is probably thickest under light load, low-speed conditions.

When a two-cycle engine is shut down or stopped, residual fuel runs off the walls and other surfaces within the engine and collects at the lowest point in the crankcase. In horizontal cylinder, two-cylinder engines, such as are used, for example, in marine outboard motors, a transfer passage communicating with a cylinder combustion chamber is typically provided below each cylinder. Because such a transfer passage often forms the lowest point within the crankcase, particularly in the case of loop scavenged engines, it is a likely site for the accumulation of residual fuel, and when the engine is shut down, enough residual fuel can accumulate in the transfer passage to form a significant puddle. During subsequent restarting of the engine, the accumulated puddle can be blown almost instantaneously through the transfer passage into the combustion chamber. Because the accumulated residual fuel cannot be completely burned, a noticeable cloud of smoke is produced at the engine's exhaust.

In one two-cycle internal combustion engine, such as that shown, for example, in U. S. Griffiths U.S. Pat. No. 4,383,503, a segment of tubing is used in conjunction with a check valve to recirculate residual fuel from the transfer passage to the combustion chamber during engine operation in order to avoid the accumulation of residual fuel while the engine is running. This system will not, however, prevent the accumulation of a residual fuel puddle when the engine is shut down, and smoke can still be produced when the engine is restarted.

In anoher two-cycle internal combustion engine, such as that shown, for example, in Hundertmark U.S. Pat. No. 4,590,897, a sump is provided for collecting residual fuel from the engine crankcase, and a delivery line returns collected residual fuel to the engine when the engine is operating above a predetermined speed. However, as no provision is made for draining accumulated residual fuel from the transfer passage while the engine is shut down, smoke can still be produced as the accumulated residual fuel is blown into the combustion chamber during a subsequent engine restart.

Attention is also directed to the following U.S. Pat. Nos.

4,359,975, Heidner, Nov. 23, 1982;

4,286,553, Baltz, et al., Sept. 1, 1981;
4,213,431, Onishi, July 22, 1980;
4,181,101, Yamamoto, Jan. 1, 1980;
4,180,029, Onishi, Dec. 25, 1979;
4,176,631, Kanao, Dec. 4, 1979;
4,121,551, Turner, Oct. 24, 1978;
4,063,540, Pace, Dec. 20, 1977;
3,929,111, Turner, et al., Dec. 30, 1975;
3,859,967, Turner, et al., Jan. 14, 1975;
3,805,751, Resnick, et al., Apr. 23, 1974;
3,800,753, Sullivan, et al., Apr. 2, 1974;
3,762,380, Schultz, Oct. 2, 1973;
3,730,149, Brown, May 1, 1973;
3,709,202, Brown, Jan. 9, 1973;
3,528,395, Goggi, Sept. 15, 1970;
3,170,449, Goggi, Feb. 23, 1965;
3,128,748, Goggi, Apr. 14, 1964;
2,857,903, Watkins, Oct. 28, 1958;
2,781,632, Meijer, Feb. 19, 1957;
2,717,584, Upton, Sept. 13, 1955;
2,682,259, Watkins, June 29, 1954;
2,502,968, Lundquist, et al., Apr. 4, 1950;
1,733,431, Sherman, Oct. 29, 1929.

SUMMARY OF THE INVENTION

The invention provides a marine propulsion device comprising a lower unit including a rotatably mounted propeller, and an internal combustion engine operable in a predetermined mode and adapted to be drivingly connected to the propeller, the engine including an engine block, a sump having an outlet and having an unobstructed inlet communicating with the engine block to provide a free gravity flow path from the engine block into the sump, a controllable valve communicating with the outlet, a fluid conduit communicating with the controllable valve and with a preselected location within the engine block, and control means responsive to operation of the engine in the predetermined mode for opening the controllable valve when the engine is operating in the predetermined mode.

The invention also provides an internal combustion engine operable in a predetermined mode, the engine comprising an engine block, a sump having an outlet and having an unobstructed inlet communicating with the engine block to provide a free gravity flow path from the engine block into the sump, a controllable valve communicating with the outlet, a fluid conduit communicating with the controllable valve and with a preselected location within the engine block, and control means responsive to operation of the engine in the predetermined mode to open the valve when the engine is operating in the predetermined mode.

The invention also provides a two-cycle internal combustion engine operable in a predetermined mode, the engine comprising an engine block having a substantially horizontal cylinder, a transfer passage formed within the engine block substantially below the horizontal cylinder and communicating with the horizontal cylinder and having a region of maximum vertical displacement from the cylinder forming a low point in the transfer passage, a sump below the transfer passage having an outlet and having an unobstructed inlet above the outlet and communicating with the transfer pasage substantially at the low point to provide a free gravity flow path from the transfer passage into the sump, a controllable valve coupled to the outlet for controlling fluid flow from the sump through the outlet, a fluid conduit coupled between the controllable valve and a preselected location within the engine block for communicating fluid from the valve to the preselected location, and control means responsive to engine operation in the predetermined mode for opening the valve when the engine is operating in the predetermined mode.

In one embodiment, the predetermined mode comprises continuous engine operation in excess of a predetermined time period such that the control means opens the valve when the engine has been in continuous operation in excess of the predetermined time period.

In one embodiment, the predetermined mode comprises engine operation at a predetermined engine operating temperature such that the control means opens the valve when the engine reaches the predetermined operating temperature.

In one embodiment, the internal combustion engine further comprises a transmission for selectively connecting the engine to the propeller, and the predetermined mode comprises engine operation in conjunction with operation of the transmission to drive the propeller such that the control means opens the valve when the transmission drivingly connects the engine to the propeller.

In one embodiment, the engine block includes a plurality of the cylinders and the engine includes a plurality of the sumps, the controllable valves, the fluid conduits and the control means individually associated with individual ones of the cylinders, and the predetermined location for each of the cylinders comprises another cylinder.

In one embodiment, the engine further includes a check valve communicating with the controllable valve and oriented to permit fluid flow from the outlet through the controllable valve.

Various other principal features of the invention will become apparent to those skilled in the art upon review of the following detailed description, claims and drawings.

Figure 2:
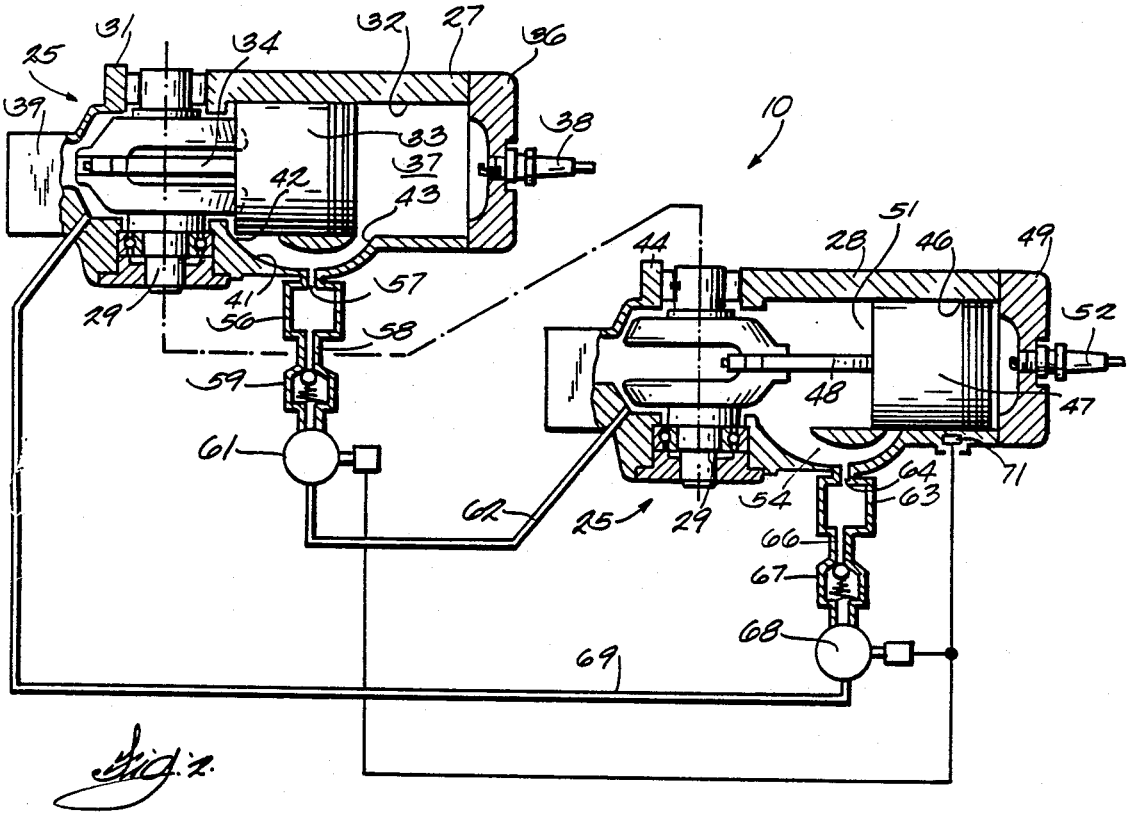
FIG. 2 is a schematic representation of a dual, horizontal cylinder, 2-cycle engine adapted for use in the marine propulsion device of FIG. 1 and including a fuel residual handling system embodying the invention.

Before one embodiment of the invention is explained in detail, it is to be understood that the invention is not limited in its application to the details of construction and the arrangement of components set forth in the following description or illusrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

A 2-cycle, multiple horizontal cylinder, spark ignited internal combustion engine 10 incorporating a fuel residual handling system in accordance with the invention is illustrated in the drawings. Such an engine is particularly well suited for use in a marine propulsion device such as an outboard motor 11 (FIG. 1) or a stern drive unit (not shown). It will be appreciated, however, that the 2-cycle internal combustion engine 10 is also suited for use in other applications.

Figure 1:
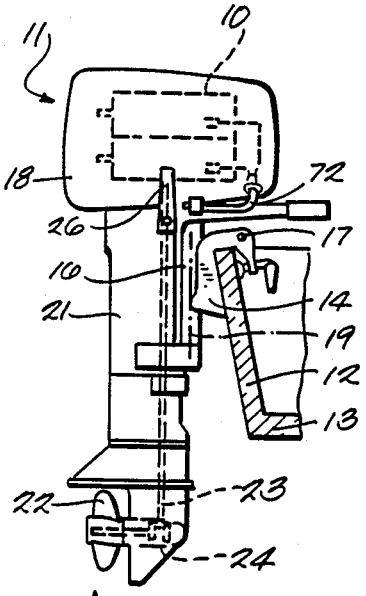
FIG. 1 is a side elevational view of a marine propulsion device embodying the invention and incorporating a horizontal cylinder, 2-cycle engine including a fuel residual handling system in accordance with the invention.

As best shown in FIG. 1, the marine propulsion device or outboard motor 11 comprises a mounting assembly fixedly attached to the transom 12 of a boat 13. While various suitable mounting assemblies can be employed, in the preferred embodiment, the mounting assembly includes a transom bracket 14 fixedly attached to the transom 12, and a swivel bracket 16 mounted on the transom bracket 14 for pivotal movement of the swivel bracket 16 relative to the transom bracket 14 about a generally horizontal tilt axis 17.

The marine propulsion device or outboard motor 11 also comprises a propulsion unit 18 mounted on the swivel bracket 16 for pivotal movement of the propulsion unit 18 relative to the swivel bracket 16 about a generally vertical steering axis 19. The propulsion unit 18 includes a lower unit 21 having thereon a rotatably mounted propeller 22. The 2-cycle, horizontal cylinder, spark ignited internal combustion engine 10 is mounted above the lower unit 21 and is drivingly conected to the propeller 22 by means of a drive shaft 23 and a controllably engageable transmission 24. Engagement of the transmission 24 is controlled by means of a manual shift lever 26 mounted adjacent the upper end of the lower unit 21.

Referring to FIG. 2, the internal combustion engine 10 includes an engine block 25 having a pair of horizontally disposed cylinders 27 and 28 operatively driving a common crankshaft 29. Cylinder 27 includes a crankcase 31 having a horizontally extending cylinder bore 32 and a piston 33 mounted for reciprocation within the cylinder bore 32. A connecting rod 34 operatively couples the piston 33 to the crankshaft 29. Opposite the connecting rod 34, the cylinder 27 includes a cylinder head 36 which defines a combustion chamber 37 within the cylinder bore 32 between the piston 33 and the cylinder head 36.

During movement of the piston 33 toward the cylinder head 36, a fuel/oil mixture is drawn into the crankcase 31 through a carburetor 39 which mixes the fuel/oil mixture with air to form a combustible fuel/oil/air mixture. During movement of the piston 33 away from the cylinder head 36, the fuel/oil/air mixture within the crankcase is partially compressed. A spark plug 38 is mounted to the cylinder head 36 and functions to ignite the fuel/oil/air mixture within the combustion chamber 37 during engine operation.

To transfer the partially compressed fuel/oil/air mixture into the combustion chamber 37, cylinder 27 includes a transfer passage 41 formed in the engine block 25 below the cylinder bore 32. The transfer passage 41 comprises a generally U-shaped open-ended passageway having one end 42 opening into the interior of the crankcase 31 and an opposite end 43 opening into the combustion chamber when the piston 33 reaches a position farthest from the cylinder head 36 during reciprocation within the cylinder bore 32.

Cylinder 28 is substantially similar or identical to cylinder 27 in construction and operation and includes a crankcase 44 having a cylinder bore 46 and a piston 47 mounted for reciprocation within the cylinder bore 46. A connecting rod 48 couples the piston 47 with the common crankshaft 29, and the cylinder 28 further includes a cylinder head 49 which, together with the piston 47, forms a combustion chamber 51 within the cylinder 28. The cylinder 28 also has associated therewith a spark plug 52, a carburetor 53 and a transfer passage 54 formed within the engine block 25 below the cylinder bore 46. In accordance with conventional practice, the engine 10 is arranged so that pistons 33 and 47 each reach top dead center within their respective cylinder bores 32 and 46 at different times.

As illustrated, the transfer passages 41 and 54 form the lowermost points within the engine block 25. Accordingly, the transfer passages 41 and 54 are the most likely locations for the accumulation of residual fuel/oil mixture within the engine block 25 after the engine is shut down following a period of engine operation. If such residual mixture were peritted to remain within the transfer passages 41 and 54, such accumulated residual mixture would be blow substantially at once into the combustion chambers 37 and 51 upon a subsequent engine restart. This, in turn, can result in a noticeably smoky exhaust as the engine is restarted.

To prevent the accumulation of residual mixture within the transfer passages 41 and 54 while the internal combustion engine 10 is not operating, the internal combustion engine 10 includes a fuel residual handling system which functions to drain excess residual mixture from the tranfer passages, store the drained excess residual fuel during subsequent restarting of the engine, and then reintroduce the drained excess fuel into the engine only when the engine is operating in a predetermined mode favorable for such reintroduction.

As best shown in FIG. 2, cylinder 27 is provided with a hollow fuel storage chamber or sump 56 having an unobstructed inlet 57 communicating with the transfer passage 41 substantially at the lowermost point within the transfer passage. Because the inlet 57 is unobstructed, the inlet provides a free gravity flow path from the transfer passage 41 into the sump 56. Accordingly, residual mixture accumulating within the transfer passage 41 while the engine is not operating will flow unimpeded through the inlet 57 and will accumulate within the sump 56. Preferably, the shape and dimension of the unobstructed inlet 57 is such that accumulated residual mixture within the sump 56 will not readily splash or be sucked from the sump back into the transfer passage 41 during subsequent restarting of the engine. Accordingly the volume or capacity of the sump 56 is sufficient to fully contain the total quantity of residual mixture likely to collect after the engine is shut-down. This quantity varies from engine to engine and is best determined experimentally. In practice, the inlet 57 can comprise a fluid fitting communicating with the transfer passage 41, and the sump 56 can comprise a length of tubing coupled to the fitting.

To provide for the drainage of accumulated residual fuel from the sump 56, the fuel residual handling system further includes an outlet 58 communicating with the sump 56 and a check valve 59 connected to the outlet 58 and oriented so as to permit one-way flow of accumulated residual fuel from the sump 56 through the outlet 58. Additionally, the fuel residual handling system further includes a controllable valve 61 having one end communicating through the check valve 59 with the outlet 58 of the sump 56 and having another end communicating through a fluid conduit 62 with a preselected location within the engine block 25. Although in the embodiment illustrated the check valve 59 is positioned upstream of the controllable valve 61, it will be appreciated that the check valve 59 can be located downstream of the controllable valve 61.

To further facilitate drainage of accumulated residual fuel from the sump 56, the preselected location preferably provides a relatively low pressure to the fluid conduit 62 when the pressure in the transfer passage 41 is relatively high. In the embodiment shown in FIG. 2, the preselected location to which accumulated residual fuel is communicated from the sump 56 is the crankcase 44 of the other cylinder 28. Because pistons 33 and 47 move in substantially opposite directions relative to each other during engine operation, pressure in the crankcase 44 will be relatively low when the pressure in the transfer passage 41 is relatively high and vice versa. When pressure at the drainage location is lower than in the transfer passage, the check valve 59 opens, and, provided the controllable valve 61 is also open, accumulated residual fuel is drained from the sump 56. When the pressure at the drainage location exceeds pressure in the transfer passage 41, the check valve 59 closes and reverse fluid flow from the conduit 62 into the sump 56 is prevented.

Preferably, the controllable valve 61 comprises a solenoid actuated valve which opens and closes in response to the application of appropriate control currents. Alternativley, the valve can comprise a mechanically actuated valve which opens and closes in response to an appropriate mechanical input.

The other cylinder 28 is also provided with a sump 63 having an unobstructed inlet 64 providing a free gravity flow path from the transfer passage 54 into the sump. The sump 63 includes an outlet 66 communicating, through a check valve 67, a controllable valve 68, and a fluid conduit 69, with another preselected location within the engine block 25. In the embodiment shown, this preselected location is the crankcase 31 of the other cylinder 27.

To assure that accumulated residual fuel is drained from the sumps 56 and 63 only when the engine is operating in a predetermined mode suitable for the reintroduction of such accumulated residual fuel, the fuel residual handling system further includes control means, responsive to operation of the internal combustion engine 10 in the predetermined mode, for opening the controllable valves 61 and 68 when the engine is operating in the predetermined mode. While various suitable control means can be employed, in the embodiment shown in FIG. 2, the control means includes a temperature sensing element 71 thermally coupled to the engine block 25 adjacent cylinder 28 and electrically coupled to each of the controllable valves 61 and 68. The temperature sensor 71 is selected so as to provide a suitable electrical output for opening the controllable valves 61 and 68 only when the internal combustion engine 10 has reached a predetermined operating temperature as indicated by the temperature of the cylinder block 25 adjacent the cylinder 28. Thus, in the embodiment shown in FIG. 2, fuel will be drained from the sumps 56 and 63 only when the engine 10 is operating at or above the predetermined temperature. Because such a temperature will not ordinarily be reached until the engine has been operating for several seconds or minutes, the reintroduction of accumulated residual fuel into the cylinders 27 and 28 will not take place during engine restarting, the time most favorable for the production of excessive exhaust smoke. Although the temperature sensor 1 is shown as being mounted adjacent cylinder 28, it will be appreciated that other locations for the temperature sensor can be selected.

An alternative embodiment of the fuel handling system is illustrated in FIG. 1. When the internal combustion engine 10 is incorporated into a marine propulsion device, such as the illustrated outboard motor 11, the fuel residual handling system can be arranged such that drainage of accumulated residual fuel from the sumps 56 and 63 is permitted only when the transmission 24 is engaged so that the marine propulsion device is actually providing propulsion to a boat. When the marine propulsion device is operating in such a mode, (i.e., the manual shift lever 26 is in a position other than "neutral") exhaust gases developed by the internal combustion engine 10 are vented through the lower unit 21 and are discharged under water. Accordingly, any smoke produced as the accumulated residual fuel is reintroduced into the cylinder crankcases 31 and 44 will be less noticeable than when the transmission 24 is in neutral and the boat is stationary.

In the embodiment illustrated in Figure 1, the temperature sensor 71 is replaced by an electrical switch 72 which is mechanically coupled to the shift control lever 26 and is arranged so as to provide an appropriate electrical signal for opening the controllable valves 61 and 68 only when the shift control lever 26 is in a position other than neutral. Alternatively, a purely mechanically actuated valve can be mechanically coupled to the shift control lever through an appropriate linkage.

Figure 3:
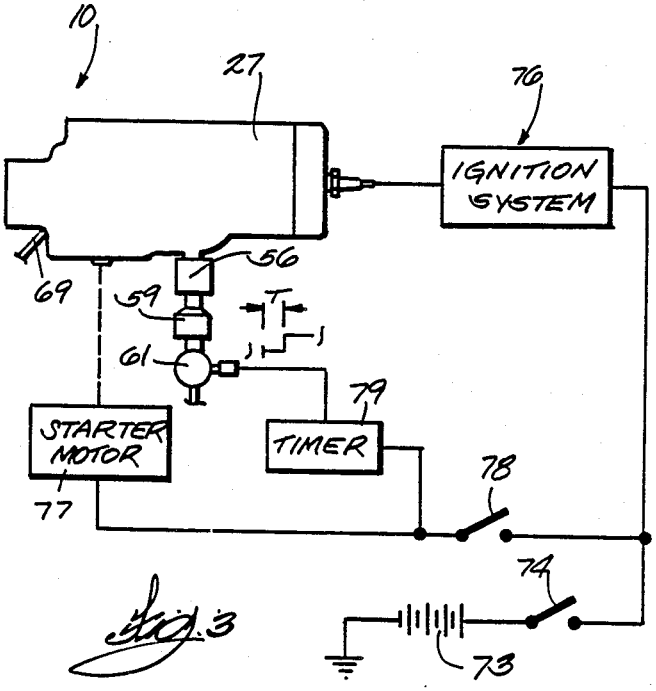
FIG. 3 is a schematic representation of a horizontal cylinder, 2-cycle internal combustion engine including an alternative embodiment of a fuel residual handling system embodying the invention.

Still another embodiment of the fuel residual handling system is illustrated in FIG. 3, which figure shows one cylinder 27 of the multiple horizontal cylinder 10. In FIG. 3, an electrical battery 73 is provided and is electrically coupled through an ignition switch 74 to various circuits comprising the engine's ignition system indicated generally at 76. A starter motor 77 is provided for cranking the engine 1 during starting and is coupled through a starter switch 78 and the ignition switch 74 to the battery 73. Both the starter switch 78 and the ignition switch 74 must be closed in order to actuate the starter motor 77.

To assure that accumulated residual fuel is not drained from the sump 56 until after the engine is started and operating smoothly, the fuel residual handling system in the embodiment shown in FIG. 3 includes a timer circuit 79 which is enabled and triggered upon closure of both the ignition and starter switches 74 and 77, and which, after a predetermined time period T, applies a control current to the controllable valve 61 to permit drainage of accumulated residual fuel from the sump 56. In this embodiment, accumulated residual fuel cannot be drained from the sump 56 until after the time period T has elapsed following closure of the ignition and starter switches 74 and 78. This assures that fuel reintroduction is not initiated until after the engine is started and running.

Although the internal combustion engine 10 has been shown and described in the context of a marine propulsion device, it will be appreciated that the engine can also be used in other, non-marine applications. Additionally, although a two-cylinder engine has been described for illustrative purposes, it will be appreciated that the fuel residual handling system can be adapted for use in engines having a fewer or greater number of cylinders. Similarly, although the invention has been shown and described in the context of a carbureted engine, the invention is equally well suited for use with engines using other forms of fuel delivery such as fuel injection. Finally, although specific locations for reintroducing accumulated residual fuel into the engine block 25 have been identified, it will be appreciated that other locations can be selected.

Various other features and advantages of the invention are set forth in the following claims.

We claim:

1. A marine propulsion device comprising an internal combustion engine operable in a predetermined mode and adapted to be drivingly connected to a propeller, said engine including an engine block, a controllable valve, a fluid conduit communicating with said controllable valve and with a preselected location within said engine block, control means responsive to operation of said engine in said predetermined mode for opening said controllable valve when said engine is operating in said predetermined mode, and a sump having a single outlet solely communicating with said controllable valve and having an unobstructed inlet communicating with said engine block to provide a free gravity flow path for fuel drains from said engine block ino said sump.

2. A marine propulsion device in accordance with claim 1 wherein said engine further includes a check valve communicating with said controllable valve and oriented to permit fluid flow from said outlet through said controllable valve.

3. A marine propulsion device in accordance with claim 1 wherein said predetermined mode comprises engine operation at a predetermined engine operating temperature such that said control means opens said valve when said engine substantially reaches said predetermined operating temperature.

4. A marine propulsion device comprising an internal combustion engine adapted to be drivingly connected to a propeller and operable in a predetermined mode comprising continuous engine operation in excess of a predetermined time period, said engine including an engine block, a sump having an outlet and having an unobstructed inlet communicating with said engine block to provide a free gravity flow path from said engine block into said sump, a controllable valve communicating with said outlet, a fluid conduit communicating wih said controllable valve and with a preselected location within said engine block, and control means responsive to continuous engine operation in excess of said predetermined time period for opening said controllable valve.

5. A marine propulsion device comprising an internal combustion engine adapted to be drivingly connected to a propeller and including an engine block, a transmission operable to selectively connect said engine to the propeller, a sump having an outlet and having an unobstructed inlet communicating with said engine block to provide a free gravity flow path from said engine block into said sump, a controllable valve communicating with said outlet, a fluid conduit communicating with said controllable valve and with a preselected location within said engine block, and control means for opening said controllable valve in response to engine operation in conjunction with operation of said transmission to drivingly connect said engine to the propeller.

6. A marine propulsion device comprising a lower unit including a rotatably mounted propeller and an internal combustion engine operable in a predetermined mode and adapted to be drivingly connected to said propeller, said engine comprising an engine block including first and second cylinders, first and second sumps respectively having first and second outlets and respectively having first and second unobstructed inlets communicating respectively with said engine block to provide first and second free gravity flow paths from said engine block into said sumps, first and second controllable valves respectively communicating with said first and second outlets, first and second fluid conduits respectively communicating with said first and second controllable valves and with first and second preselected locations within said engine block, said first and second predetermined locations for said first and second cylinders respectively comprising another cylinder, and first and second control means responsive to operation of said engine in said predetermined mode for respectively opening said controllable valves when said engine is operating in said predetermined mode.

7. An internal combustion engine operable in a predetermined mode, said engine comprising an engine block, a controllable valve, a fluid conduit communicating with said controllable valve and with a preselected location within said engine block, control means responsive to operation of said engine in said predetermined mode for opening said controllable valve when said engine is operating in said predetermined mode, a sump having an unobstructed inlet communicating with said engine block to provide a free gravity flow path for fuel drains from said engine block into said sump, and having a single outlet communicating solely with said controllable valve.

8. An internal combustion engine in accordance with claim 7 wherein said engine further includes a check valve communicating with said controllable valve and oriented to permit fluid flow from said outlet through said controllable valve.

9. An internal combustion engine in accordance with claim 7 wherein said predetermined mode comprises engine operation at a predetermined engine operating temperature such that said control means opens said valve when said engine substantially reaches said predetermined operating temperature.

10. An internal combustion engine operable in a predetermined mode comprising continuous engine operation in excess of a predetermined time period, said engine comprising an engine block, a sump having an outlet and having an unobstructed inlet communicating with said engine block to provide a free gravity flow path from said engine block into said sump, a controllable valve communicating with said outlet, a fluid conduit communicating with said controllable valve and with a preselected location within said engine block, and control means for opening said valve when said engine has been in continuous operation in excess of said predetermined time period.

11. An internal combustion engine operable in a predetermined mode comprising an engine adapted to be drivingly connected to a propeller and including an engine block, a transmission operable to selectively connect said engine to the propeller, a sump having an outlet and having anunobstructed inlet communicating with said engine block to provide a free gravity flow path from said engine block into said sump, a controllable valve communicating with said outlet, a fluid conduit communicating with said controllable valve and with a preselected location within said engine block, and control means for opening said controllable valve in response to engine operation in conjunction with operation of said transmission to drivingly connect said engine to the propeller.

12. An internal combustion engine operable in a predetermined mode, said engine comprising an engine block, first and second sumps having first and second outlets and first and second unobstructed inlets communicating respectively with said engine block to provide first and second free gravity flow path from said engine block into said first and second sumps, first and second controllable valves respectively communicating with said first and second outlets, first and second fluid conduits communicating respectively with said first and second controllable valves and with first and second preselected locations within said engine block, and first and second control means responsive to operation of said engine in said predetermined mode for respectively opening said first and second controllable valve when said engine is operating in said predetermined mode, said first and second predetermined locations for said first and second cylinders comprises another cylinder.

13. A two-cycle internal combustion engine operable in a predetermined mode, said engine comprising an engine block having a substantially horizontal cylinder, a transfer passage formed within said engine block substantially below said horizontal cylinder and communicating with said horizontal cylinder and having a region of maximum vertical displacement from said cylinder forming a low point in said transfer passage, a sump located below said transfer passage and having only a single outlet and having an unobstructed inlet above said outlet and communicating with said transfer passage substantially at said low point to provide a free gravity flow path for fuel drains from said transfer passage into said sump, a controllable valve coupled to said outlet for exclusively controlling fluid flow from said sump, a fluid conduit coupled between said controllable valve and a preselected location within said engine block for communicating fluid from said valve to said preselected location, and control means responsive to engine operation in said predetermined mode for opening said valve when said engine is operating in said predetermined mode.

14. A two-cycle internal combustion engine in accordance with claim 13 wherein said engine further includes a check valve communicating with said controllable valve and oriented to permit fluid flow from said outlet through said controllable valve.

15. A two-cycle internal combustion engine in accordance with claim 13 wherein said predetermined mode comprises engine operation at a predetermined engine operating temperature such that said control means opens said valve when said engine substantially reaches said predetermined operating temperature.

16. A two-cycle internal combustion engine operable in a predetermined mode comprising continuous engine operation in excess of a predetermined time period, said engine comprising an engine block having a substantially horizontal cylinder, a transfer passage formed within said engine block substantially below said horizontal cylinder and communicating with said horizontal cylinder and having a region of maximum vertical displacement from said cylinder forming a low point in said transfer passage, a sump below said transfer passage having an outlet and having an unobstructed inlet above said outlet and communicating with said transfer passage substantially at said low point to provide a free gravity flow path from said transfer passage into said sump, a controrllable valve coupled to said outlet for controlling fluid flow from said smp through said outlet, a fluid conduit coupled between said controllable valve and a preselected location within said engine block for communicating fluid from said valve to said preselected location, and control means for opening said valve when said engine has been in continuous operation in excess of said predetermined time period.

17. A two-cycle internal combustion engine comprising an internal combustion engine adapted to be drivingly connected to a propeller and including an engine block having a substantially horizontal cylinder, a transfer passage formed within said engine block substantially below said horizontal cylinder and communicating with said horizontal cylinder and having a region of maximum vertical displacement from said cylinder forming a low point in said transfer passage, transmission operable to selectively connect said engine to the propeller, a sump below said transfer passage having an outlet and having an unobstructed inlet above said outlet and communicating with said transfer passage substantially at said low point to provide a free gravity flow path from said transfer passage into said sump, a controllable valve couple to said outlet for controlling fluid flow from said sump through said outlet, a fluid conduit coupled between said controllable valve and a preselected location within said engine block for communicating fluid from said valve to said preselected location, and control means for opening said controllable valve in response to engine operation in conjunctin with operation to said transmission to drivingly connect said engine to the propeller.

18. A two-cycle internal combustion engine operable in a predetermined mode, said engine comprising an engine block having first and second substantially horizontal cylinders, first and second transfer passages respectively formed within said engine block substantially below said first and second horizontal cylinders and respectively communicating with said first and second horizontal cylinders and having respective regions of maximum vertical displacement from said first and second cylinders and respectively forming low points in said first and second transfer passages, first and second sumps located below said first and second transfer passages and having respective first and second outlets and respective unobstructed first and second inlets located above said first and second outlets and respectively communicating with said first and second transfer passages substsantially at said first and second low points to provide respective free gravity flow paths from said first and second transfer passages into said first and second sumps, first and second controllable valves respectively coupled to said first and second outlets for respectively controlling fluid flow from said first and second sumps through said first and second outlets, first and second fluid conduits respectively coupled between said first and second controllable valves and respective first and second preselected locations within said engine block for respectively communicating fluid from said valves to said preselected locations, saif first and second predetermind locations for said first and second cylinders respectively comprising the combustion chamber of another cylinder, and first and second control means respectively responsive to engine operation in said predetermined mode for opening said first and second valves when said engine is operating in said predetermined mode.

* * * * *